US005401011A

United States Patent [19]

Gatenby et al.

[11] Patent Number: 5,401,011

[45] Date of Patent: Mar. 28, 1995

[54] BELT CLAMP

[76] Inventors: Alan D. Gatenby, 542 S. 560 E., Orem, Utah 84058; Lloyd V. Carter, 3450 N. University Ave., Provo, Utah 84604

[21] Appl. No.: 251,725

[22] Filed: May 31, 1994

[51] Int. Cl.[6] ..... B25B 1/04

[52] U.S. Cl. ..... 269/131; 81/64; 29/283; 29/281.1

[58] Field of Search ..... 269/3, 287, 130–132, 269/108; 81/64, 3.43; 29/283, 281.1

[56] References Cited

U.S. PATENT DOCUMENTS 799,155 9/1905 Gill et al. ..... 81/64

3,292,922 12/1966 Nastev ..... 269/131

4,872,654 10/1989 Seele ..... 269/130

*Primary Examiner*—Robert C. Watson

*Attorney, Agent, or Firm*—Delbert R. Phillips

[57] ABSTRACT

A belt clamp stabilizing an intact belt while it encompasses a pulley formed from a rear plate, front plate, 2 cams, and a center block with griping surfaces. The clamp is easily attached to an existing belt without having two cut an additional belt. A breaker bar may be attached to the Belt Clamp to stabilize the clamp and the pulley to which the belt is attached while the nut or bolt holding the pulley to the pulley shaft is loosened or tightened.

11 Claims, 4 Drawing Sheets

BELT CLAMP

FIELD OF INVENTION

The present invention relates to a belt clamp that secures a belt while the belt is in contact with a pulley. The clamp allows the pulley to be stabilized while torque is applied to loosen a nut or bolt which secures the pulley to a shaft.

BACKGROUND OF THE INVENTION

In working on automobiles or other machinery it is necessary to remove pulleys from their shafts. Up to the development of the present invention there were no tools available to imobolize a pulley by clamping an intact belt around the pulley. The techniques for removing a pulley required disassembling the peripheral parts surrounding the pulley so that a vise or the like could be applied to the pulley to secure it while the nut or bolt fastening the pulley to the shaft was removed.

The concept of an adjustable strap wrench is conventional. Greenawalt U.S. Pat. No. 4,987,804 describes a Strap Wrench including a housing having a top, a bottom, a first side, a second opposing side, an open front end and an open back end. A cam is mounted within the housing. The cam is disposed in the housing between the top of the housing and the bottom of the housing. The center portion of the cam is attached to the housing for pivotal movement therein such that the first end and the second end of the cam means are spaced apart from the respective sides of the housing. A section of a flexible belt that has been cut is threaded through the housing in the space between the cam and the first side of the housing forming a loop. The belt is locked between the cam and the housing to prevent movement of the belt. When the belt is so locked, the piece that the belt is wrapped around is stabilized. If this device is used to stabilize a pulley while installing or removing nuts or bolts that fasten the pulley to a shaft, a belt must be cut in order to be threaded through the housing of the device.

Other types of devices that hold belts or straps securely have been described in U.S. Pat. Nos. 3,465,622 issued to Winans, U.S. Pat. No. 4,114,481 issued to Kowalczyk and U.S. Pat. No. 4,506,568 issued to Aamodt. Both Winans and Kowalczyk disclose a clamping band with a center opening and the ends of the bands connected to pivot points. While being useful in removing oil filters, these devices have pivoting points which are subject to damage and further are substantially closed loops which can be used only with workpieces which are accessible from one end so that the loop can be slid over the workpiece. Aamodt discloses the ends of a strap passing through a longitudinal slot in each part of a two part cylindrical holder and overcomes the problems presented by Winans and Kowalczyk. However, the device of Aamodt comprises two separate holder pieces which must be placed one within the other. This is not easily accomplished in restricted work space. Further, loss or misplacement of one of the holder pieces renders the device useless.

U.S. Pat. No. 1,456,126 issued to Friday describes a strap wrench that is used primarily to loosen mason jar lids. It is composed of a handle, a jaw pivotally supported at one end of the handle. A flexible clamp is secured at one end to the jaw which is secured to the handle, which limits the pivotal movement of the jaw relatively to the handle, a post is attached on the handle which has an acentric cam providing an adjustable clamp for said flexible clamping member.

A chain wrench is disclosed in U.S. Pat. No. 2,353,642 issued to Buice. U.S. Pat. No. 4,160,394 issued to Crumpacker discloses a wrench having an elongated handle received on a bracket and a flexible loop connected to the handle. Adjustment means is provided by manipulation of a sleeve surrounding a rigid inner handle section. U.S. Pat. No. 3,373,637 issued to Behnke discloses a portable rotary drive unit having a rotary drive socket with a peripheral ring gear driven by a motor. These comparatively complex devices are expensive, relatively heavy, and are not conducive to work in confined spaces. U.S. Pat. No. 1,911,815 issued to Deringer et al disclose a strap wrench in which one end of the strap is attached to an elongated handle and the other end of the strap passes through several inclines and slots in the handle to secure the strap. Operation of this device is also restricted when working in a confined space. U.S. Pat. No. 3,962,936 issued to Lewis discloses a strap wrench having loose ends mounted in a cylinder having a slot passing diametrically through the center. The slot receives both ends of the strap and the cylinder is rotated, wrapping the strap around the cylinder to produce a tightening action.

U.S. Pat. No. 701,489 issued to Love discloses a pipe wrench wherein one end of the strap is attached to a handle, the strap passing through a slot in the handle, around the workpiece over a nose on the handle, and back through the same slot in the handle. U.S. Pat. No. 1,478,110 issued to Ellison also discloses a handle having a nose thereon over which the strap passes as the strap enwraps the workpiece. The handle further has two laterally extending arms and a bridge portion in which the strap is received. U.S. Pat. No. 2,186,430 issued to Richter discloses a household implement having a handle with a slot therein. One end of a strap is attached to the handle, the strap passing through the slot, around the workpiece and returning through the slot. U.S. Patent No. 2,458,393 issued to Loudfoot discloses a handle having three aligned openings and a frictional cord having both ends attached to the handle. The frictional cord is threaded through openings to form a loop to engage the workpiece. U.S. Pat. No. 2,995,965 issued to Hockney discloses a strap having one end folded about a pin and secured to the body of the strap. The other end of the strap is looped about the workpiece and threaded through an elongated slot in a cylindrical retainer body. The retainer body has ends which may engage a handle member to rotate the retainer body to secure the strap about the workpiece.

None of the prior art provides a belt clamp that can be used on a intact belt to stabilize a pulley while pulley bolts or nuts are loosened or tightened.

SUMMARY OF THE INVENTION

This invention fills a need in the automobile repair industry for a method of installing and removing pulleys in automobiles or other machinery where space is limited by peripheral parts surrounding the pulley. This limited space prevents a vise or the like from being used to secure the pulley while the nuts or bolts fastening the pulley to the shaft are installed or removed. The Belt Clamp can be applied to an intact belt that is already in use on a pulley, thereby avoiding the need to procure and cut a second belt before beginning the process of removing or installing the nuts or bolts on a pulley as would be required by the strap wrench U.S. Pat. No. 4,987,804.

In accordance with the teachings of the present invention, there is herein disclosed a belt clamp having a top, bottom, front and rear planes. The Belt Clamp has an elongated rear plate with first and second acentric cams rotateably attached adjacent to the ends of the rear plate. A center block with griping surfaces is attached to the rear plate between the two acentric cams forming a slot between the griping surfaces and each cam to accommodate a belt. The griping surfaces are separately designed to grip various types of belts such as ribbed, flat or V shaped belts. The cams have lobes which act as levers when the cams are rotated against a belt. The cams rotate on first and second shafts which are attached to the rear plate. When the first and second cams rotate they snug against the belt, which passes between the cams and the griping surface of the center block. The center block has a angular opening on the bottom plane to engage a stabilizing tool such as a breaker bar. An elongated front plate has a first end and a second end. The front plate is rotateably attached to a fastening means which is inserted into the first shaft means near the first end of the front plate adjacent to the front of the first cam. The front plate contains a latching slot near the second end, which when the front plate is rotated, engages a post affixed to the front end of the second shaft. This post acts as a fastening means to fasten the second shaft to the rear plate.

A belt is placed in the two slots between the center block and each cam. The acentric cams, when rotated, exert pressure to grip the belt. The front plate is rotated into a latched position. A stabilizing tool is then inserted into the angular opening to finally stabilize the pulley while the nuts or bolts holding the pulley to the shaft are tightened or loosened.

DETAILED DESCRIPTION OF INVENTION

Figure 1:
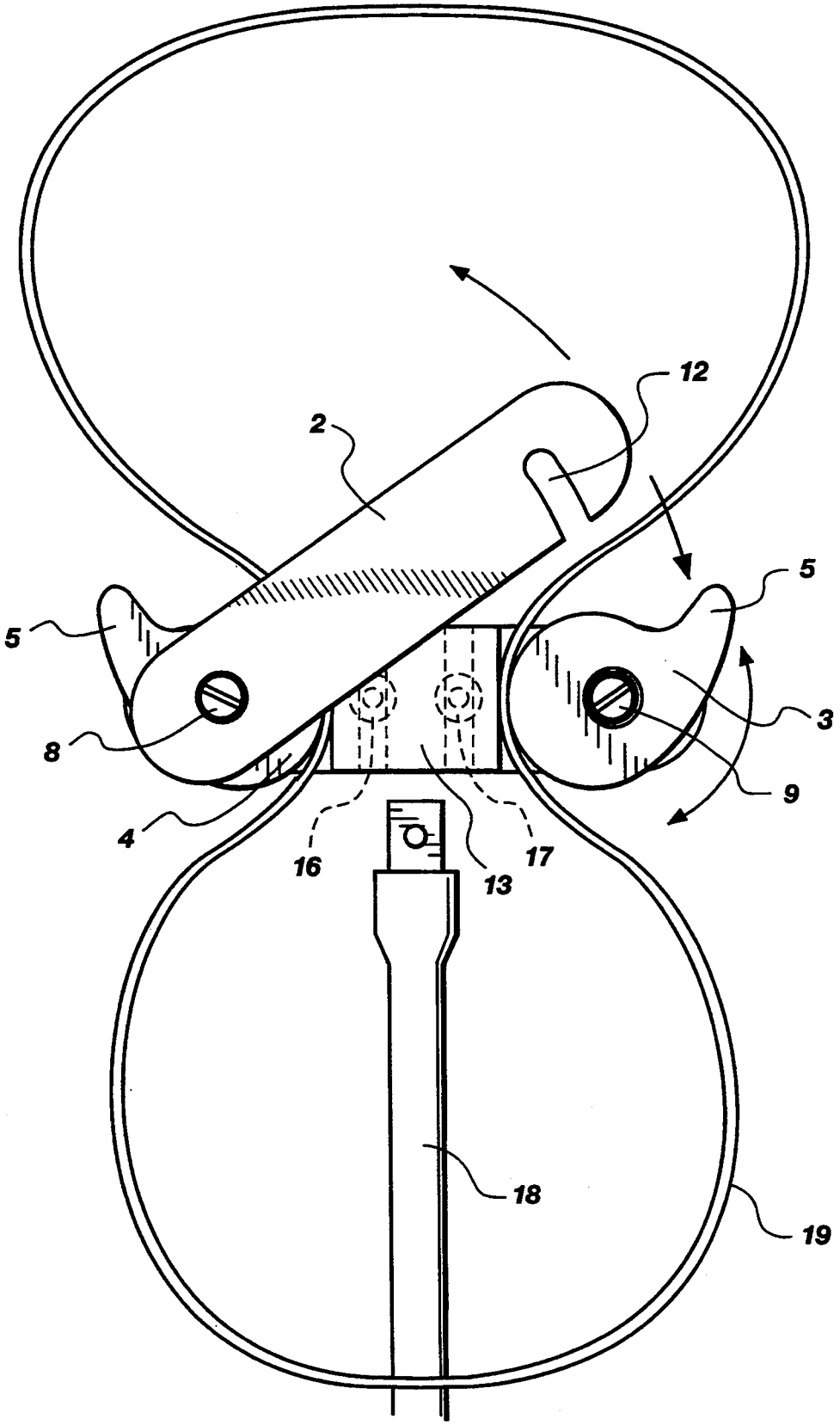
FIG. 1 depicts a front view of the Belt Clamp with the belt passing through the slots created between the center block and the two cams.

The Belt Clamp is composed of a rear plate 1. Acentric Cams 3 and 4 rotate on shafts 6 and 7 which penatrate openings in the rear plate 1. Screws 8 and 9 with washers 10 and 11 are tightened into shafts 6 and 7 to secure shafts 6 and 7 to rear plate 1. Front plate 2 is attached by means of screw 8 and washer 11 to shaft 7 on which acentric cam 3 rotates. Acentric Cam 4 rotates on shaft 6. Shafts 7 and 8 are not drilled to depth of the threading on screws 8 and 9 and thereby are tapped out. This allows space enough for rotation of front plate 2 around screw 8. The portion of screw 9 that protrudes from shaft 6 forms a post that engages slot 12 when the front plate 2 is rotated to close the clamp. Center block 13 which has griping surfaces 14 is affixed to rear plate 1 by screws 16 and 17. Griping surfaces 14 can be formed to grip ribbed belt 14$^1$ or V belt 14$^2$. Center block 13 contains a square opening 15 which accommodates a breaker bar 18 which stabilizes pulley 20 when the Belt Clamp is in position on belt 19. Cams 3 and 4 have lobes 5$^1$ and 5$^2$ which allow cams 3 and 4 to rotate against griping surfaces 14 thereby creating a griping force against belt 19. Slot 12 is angled in relationship to the top and bottom of front plate 2 to allow locking when cams 3 and 4 are rotated against belt 19.

Figure 2:
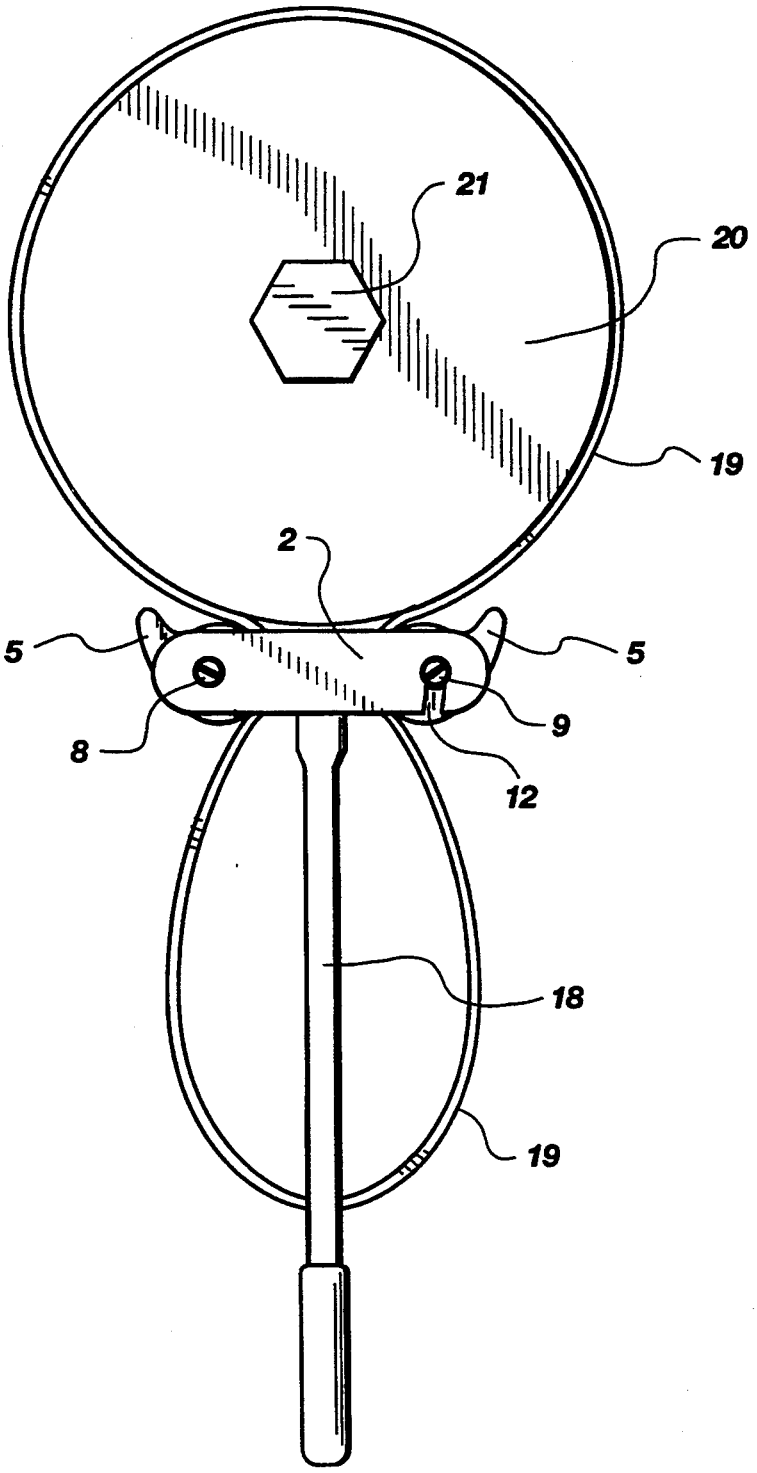
FIG. 2 depicts the Belt Clamp securing a pulley.
Figure 3:
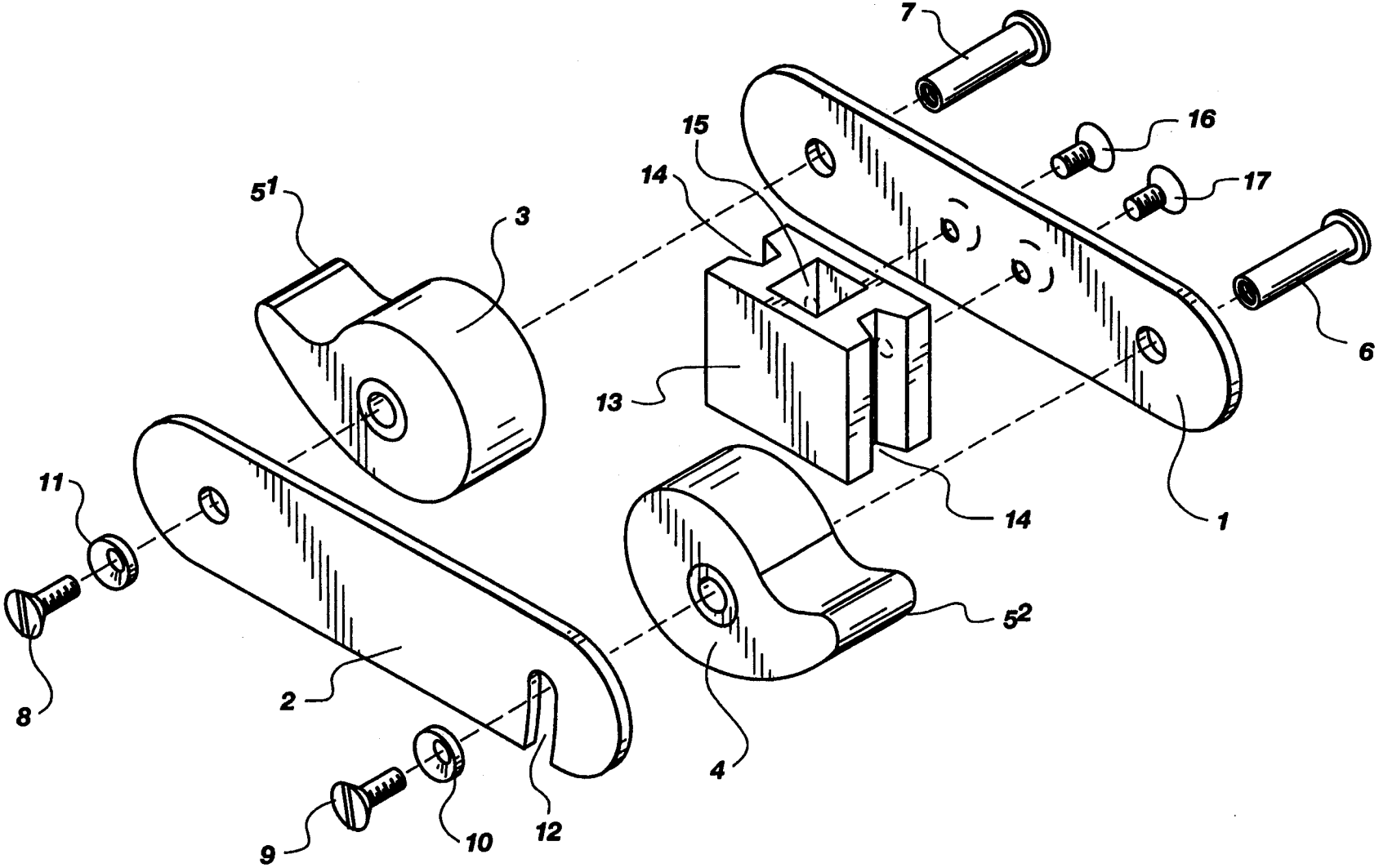
FIG. 3 depicts all the parts of the Belt Clamp in position in an exploded view.
Figure 4:
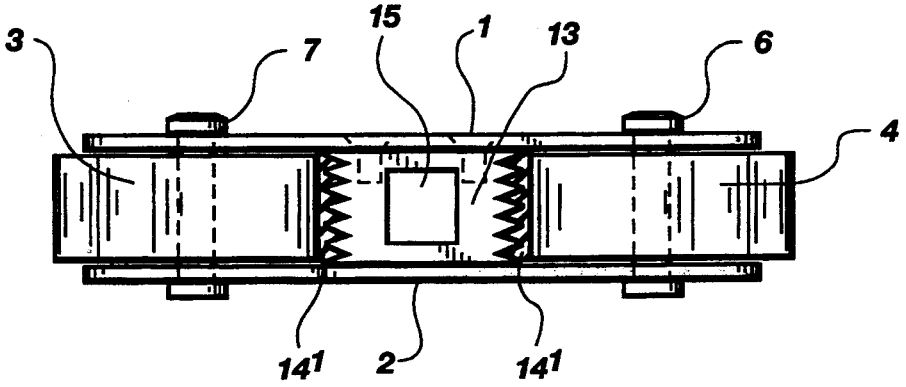
FIG. 4 is a bottom view of the belt clamp with a center block having griping surfaces formed to grip a ribbed belt.
Figure 5:
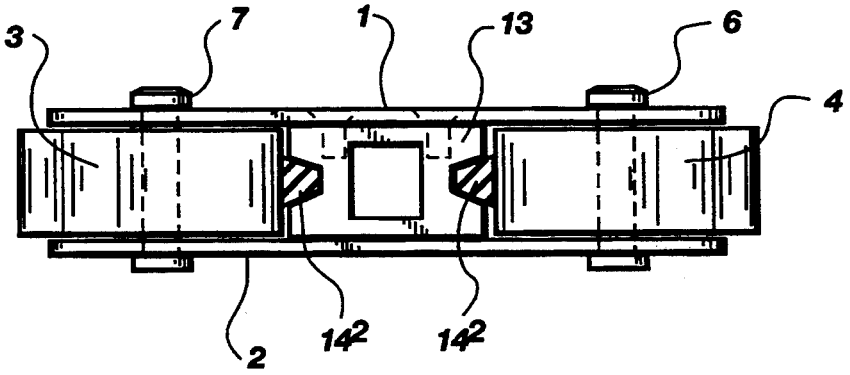
FIG. 5 is a bottom view of the belt clamp with a center block having griping surfaces formed to grip a V belt.

When the Belt Clamp is locked in position (see FIG. 2) pulley 20 is stabilized so that bolt 21 affixing the pulley to the pulley shaft can be tightened or loosened without movement of the pulley.

Center block 13 is composed of materials with high tensile strength such as rolled steel, poly carbonate, or other materials that will withstand the pressure exerted by cams 6 and 7 without deforming the griping surfaces 14. Cams 3 and 4 are composed of a more ductile material such as aluminum, cured polyethylene, solid nylon, fiber glass etc. The front plate 2 and back plate 1 are fabricated from high tensile strength material such as rolled steel. The screws 8,9,16 and 17 and shafts 6 and 7 are fabricated from standard case hardened steel or other materials that would withstand the stress.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A Belt Clamp having a front, rear, top, and bottom plane comprising;

an elongated rear plate;

said rear plate having first and second acentric cam means rotateably attached adjacent to the ends of the rear plate;

said first and second cams means rotating on first and second shaft means;

said rear plate having a center block attached thereto;

said center block having griping surfaces adjacent to said first and second acentric cams means;

said griping surfaces being designed to grip a belt;

said first and second cam means rotating snug against said belt;

an elongated front plate having a first end and a second end;

said front plate being rotateably attached near said first end of said front plate to a fastening means attached to said first shaft means adjacent to the front of the first cam means;

said front plate containing a latching slot near said second end which when rotating said front plate, engages a post affixed to the front end of said second shaft.

2. A Belt Clamp as claimed in claim 1 wherein said first and second cam means have a lobe which act as a lever when rotated against said belt.

3. A Belt Clamp as claimed in claim 1 wherein said gripping surfaces are designed to grip a ribbed belt.

4. A Belt Clamp as claimed in claim 1 wherein said gripping surfaces are designed to grip a V belt.

5. A Belt Clamp as claimed in claim 1 wherein said first and second cam means rotate on first and second shafts that protrude through openings in said rear plate.

6. A Belt Clamp as claimed in claim 5 wherein said first and second shafts are fastened to said rear plate by means of fastening means affixed to the front ends of said first and second shafts.

7. A Belt Clamp as claimed in claim 6 wherein said fastening means is a screw.

8. A Belt Clamp as calimed in claim 7 wherein a portion of said screw protruding from the front of said second shaft is said post affixed to the front of said second shaft.

9. A Belt Clamp as claimed in claim 1 wherein said center block as an angular opening.

10. A Belt Clamp as claimed in claim 9 wherein said angular opening is formed to accept the end of a stabilizing tool.

11. A Belt Clamp as claimed in claim 10 wherein said stabilizing tool is a breaker bar.

* * * * *